US007059874B2

(12) United States Patent
Weiss

(10) Patent No.: US 7,059,874 B2
(45) Date of Patent: Jun. 13, 2006

(54) ANISOTROPIC CONDUCTIVE ELASTOMER BASED ELECTRICAL INTERCONNECT WITH ENHANCED DYNAMIC RANGE

(75) Inventor: Roger E. Weiss, Foxboro, MA (US)

(73) Assignee: Paricon Technologies, Inc., Fall River, MA (US)

( * ) Notice: Subject to any disclaimer, the term of this patent is extended or adjusted under 35 U.S.C. 154(b) by 0 days.

(21) Appl. No.: 10/391,546

(22) Filed: Mar. 18, 2003

(65) Prior Publication Data

US 2003/0224633 A1 Dec. 4, 2003

Related U.S. Application Data

(63) Continuation-in-part of application No. 10/374,698, filed on Feb. 26, 2003.

(60) Provisional application No. 60/365,589, filed on Mar. 19, 2002.

(51) Int. Cl.
*H01R 4/58* (2006.01)

(52) U.S. Cl. ..... 439/91; 439/591; 439/66

(58) Field of Classification Search ..... 439/66, 439/91, 86, 591; 174/257, 259, 261; 361/785, 361/803

See application file for complete search history.

(56) References Cited

U.S. PATENT DOCUMENTS

| | | | | |
|---|---|---|---|---|
| 5,213,715 | A * | 5/1993 | Patterson et al. | 252/514 |
| 5,259,770 | A * | 11/1993 | Bates et al. | 439/66 |
| 5,317,255 | A * | 5/1994 | Suyama et al. | 324/158 P |
| 5,431,571 | A * | 7/1995 | Hanrahan et al. | 439/91 |
| 5,474,458 | A * | 12/1995 | Vafi et al. | 439/91 |
| 5,502,889 | A * | 4/1996 | Casson et al. | 174/259 |
| 5,576,519 | A * | 11/1996 | Swamy | 439/67 |
| 5,688,584 | A * | 11/1997 | Casson et al. | 174/259 |
| 5,800,650 | A * | 9/1998 | Anderson et al. | 156/150 |
| 5,818,700 | A * | 10/1998 | Purinton | 439/91 |
| 5,975,922 | A * | 11/1999 | Jin | 439/91 |
| 6,270,363 | B1 * | 8/2001 | Brofman et al. | 439/91 |
| 6,447,308 | B1 * | 9/2002 | McCarthy et al. | 439/91 |
| 6,663,799 | B1 * | 12/2003 | Kokubo et al. | 252/512 |

* cited by examiner

*Primary Examiner*—Briggitte R. Hammond
(74) *Attorney, Agent, or Firm*—Mirick, O'Connell, DeMallie & Lougee, LLP

(57) ABSTRACT

An Anisotropic Conductive Elastomer (ACE)—based electrical connector that interconnects two or more electrical circuit elements. The connector includes at least two layers of ACE separated by alternate interconnection elements that include conductive elements. The conductive elements provide void space for the ACE elastomer to move to during the interconnection process.

5 Claims, 1 Drawing Sheet

ANISOTROPIC CONDUCTIVE ELASTOMER BASED ELECTRICAL INTERCONNECT WITH ENHANCED DYNAMIC RANGE

CROSS REFERENCE TO RELATED APPLICATION

This application claims priority of Provisional application Ser. No. 60/365,589, filed on Mar. 19, 2002, and is a continuation-in-part of a patent application 10/374,698 filed on Feb. 26, 2003, entitled "Separable Electrical Interconnect with Anisotropic Conductive Elastomer and a Rigid Adapter".

FIELD OF THE INVENTION

This invention relates to a separable electrical interconnect.

BACKGROUND OF THE INVENTION

Anisotropic Conductive Elastomer (ACE) is a composite of conductive metal elements in an elastomeric matrix that is normally constructed such that it conducts along one axis only. In general this type of material is made to conduct through its thickness. In one reduction to practice, ACE achieves its anisotropic conductivity by mixing magnetic particles with a liquid resin, forming the mix into a continuous sheet and curing the sheet in the presence of a magnetic field. This results in the particles forming electrically conductive columns through the sheet thickness. The resulting structure has the unique property of being flexible and anisotropically conductive. These properties provide a useful interconnection medium.

ACE materials require that they be compressed between top and bottom conductors to provide the interconnection. This is normally done by compressing the system using a backing plate and spring arrangement. The role of the ACE is to provide an interconnection medium which, when compressed, compensates for the lack of flatness of the interconnecting components. The ability of the ACE material to compress under load is limited, and is a function of the total system geometry.

SUMMARY OF THE INVENTION

The present invention extends the dynamic range of ACE materials. ACE materials constructed of elastomers such as silicone behave like incompressible fluids in that, under the operating load, silicone will undergo no change in volume. Hence, dynamic range in ACE material is provided by moving the elastomer to open space provided either external to the ACE, or by incorporating compressible artifacts (e.g., bubbles) into the ACE. The space provided for this dynamic range can come from surface roughness of the ACE and the free volume created by (for example) the formation of spaced conductive pads surfaces adjacent to the elastomer material. The net dynamic range will be limited to a volume that which is less than the total volume of free space provided in the immediate vicinity of the contact. In essence, dynamic range is a surface phenomenon, plus volume provided elsewhere. It should be noted that the thickness of the ACE is important in that once the ACE has been compressed more than about 40% of its thickness, permanent damage to the material may occur.

This invention features an interconnect structure consisting of conductive elements such as pads on a device connected to pads on a board through an ACE medium formed by aligned particles in an elastomeric matrix. The free volume provided by the surface roughness of the ACE and space between the pads limits the total compression to a distance comparable to slightly more than the pad thickness. The present invention makes it possible to greatly increase the dynamic range of ACE materials. Two (or more) layers of ACE, separated by a layer of flex circuit material, are used. The flex circuit is constructed so that it houses an array of plated through holes that are on the same grid as the device being interconnected. Pads on both surfaces of the flex provide the interconnection, and the space around the pads provides volume for the ACE elastomer to move into as the electrical interconnection members interconnect. The thickness of the pads on the flex circuit can be adjusted as needed to increase the dynamic range of the ACE. The pads could be replaced by mechanically-formed contacts, such as metal buttons, held in place by a non-conducting member.

Although a flex circuit is described and shown below, a rigid board could also be used. Furthermore, in another preferred embodiment, a flex or rigid circuit member with circuitry that modifies the interconnection structure of the connector could be used, making it possible to re-route the interconnection inside the connector. This includes a ground plane. This technique can be applied to many connector configurations such as sockets, board to board connectors, cable connectors, etc.

BRIEF DESCRIPTION OF THE DRAWINGS

Other objects, features and advantages will occur to those skilled in the art from the following description of the preferred embodiment, and the accompanying drawings, in which:

FIG. 2 is a similar view showing the interconnect of FIG. 1 compressed to establish electrical connection there through.

DETAILED DESCRIPTION OF THE PREFERRED EMBODIMENTS

Figure 1:
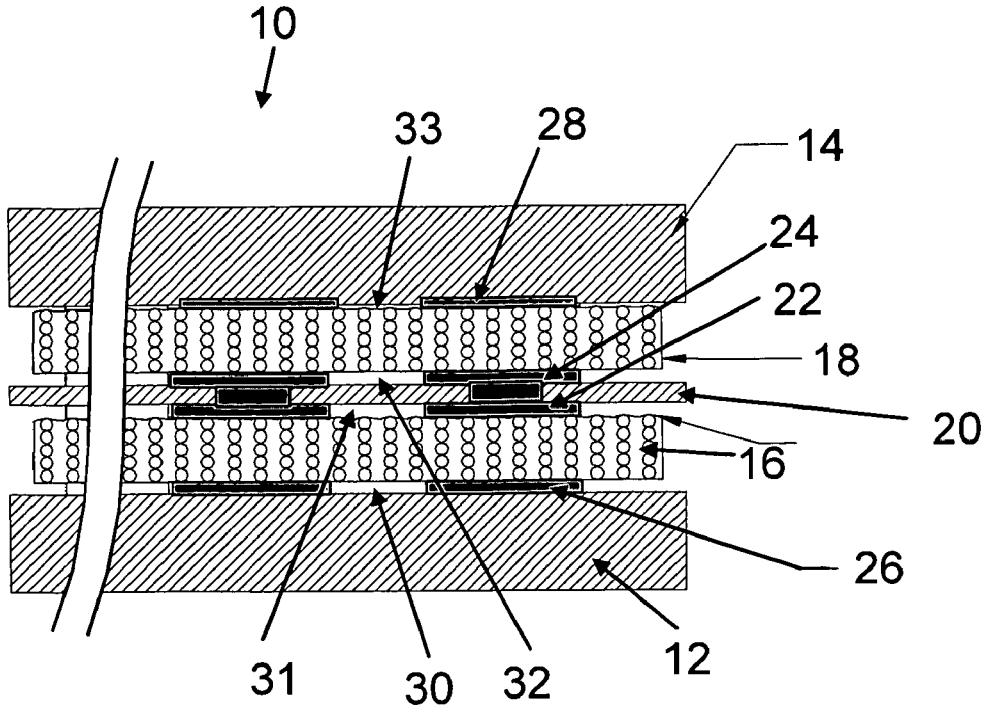
FIG. 1 is a cross-sectional schematic view of anisotropic conductive elastomer-based electrical interconnect with enhanced dynamic range according to this invention.

There is shown in FIG. 1 anisotropic conductive elastomer-based electrical interconnect with enhanced dynamic range 10 according to this invention. Interconnect 10 accomplishes separable electrical interconnection between two or more electrical circuit elements such as circuit boards 12 and 14. The inventive interconnect can be used with other types of connectors, however, such as connective sockets, cable connectors, and mother board to daughter board connections. The inventive interconnect in this embodiment comprises ACE layer 16 and ACE layer 18 separated by substrate or element 20 that carries electrical contacts held in place by a non-conducting member. The purpose of the inventive interconnect is to electrically couple conductive circuits or pads such as pad 28 of member 14 to conductive circuits or pads such as pad 26 of member 12.

ACE layers 16 and 18 need to be compressed in order to provide electrical conductivity through their thickness. Since the elastomer in the ACE behaves like an incompressible fluid, there must be voids or compressible space into which the elastomer can move when the interconnect is compressed. This is accomplished by physically separating ACE layers 16 and 18 with member 20 that defines void space such as spaces 31 and 32 at its surfaces that meet the ACE. The voids are accomplished by a series of raised and depressed areas. The raised areas in this case comprise electrical contacts such as lands 22 and 24. Plated through holes 50 or other electrical interconnects electrically interconnect lands 22 and 24. The space around pads 22 and 24 provide void volumes into which the ACE elastomer can move as the electrical interconnection members are pressed together to interconnect. The thickness of these pads can be adjusted as needed to provide a desired dynamic range to the ACE. Dynamic range is also provided by similar voids such as voids 30 and 33 defined at the surfaces of circuit elements 12 and 14 adjacent to lands, pads or other circuit elements 26 and 27, respectively.

Figure 2:
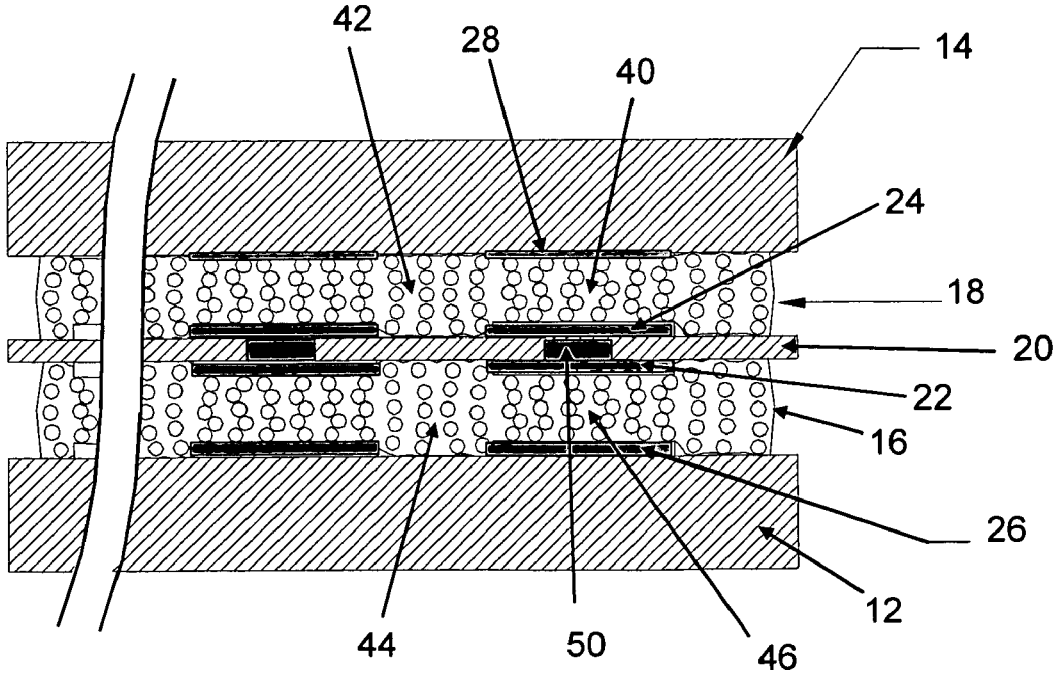

The identical interconnect of FIG. 1 is shown in the compressed, in-use state, in FIG. 2. Note the rearrangement of the electrical particles embedded in the elastomer of the ACE layers that accomplishes the electrical interconnect. As this interconnect is compressed by reducing the distance between members 12 and 14, ACE layers 16 and 18 are compressed. Since there is less distance between aligned electrical elements such as pads 28 and 24, and pads 22 and 26, as opposed to other regions of the ACE layers, the elastomer is compressed in these areas (areas 40 and 46, respectively), while allowed to expand in unrestricted areas such as 42 and 44.

This result is accomplished if the thickness of the circuit elements of member 20 are sufficient to define big enough void spaces to allow for movement of the elastomer material when the interconnect is compressed.

As can be seen from the drawing, the conductive magnetic particles in the ACE layers (represented as small spheres) are pushed together in areas 40 and 46 where the ACE is compressed, thereby providing electrical continuity between the vertically adjacent pads. Electrical interconnection is thus provided between members 12 and 14. In areas without pads, such as areas 42 and 44, the elastomer is actually expanding, which decreases any opportunity for these conductive particles to form an undesired electrical path through the thickness of the ACE in these areas.

This invention contemplates different manners of accomplishing interconnection element 20 that lies between the two layers of ACE material. This is preferably accomplished with a flexible circuit board with pads on each surface connected by plated-through holes in a standard fashion. The flex circuit provides some additional compliance to the interconnect. Alternatively, but not preferably, a rigid circuit board with surface pads or lands can be used. Another alternative is to provide mechanically-produced connectors such as buttons or rivet-like members that are held in an insulator such that the connector surfaces protrude above the insulator; for example with electrical contacts that comprise a transverse body with protruding enlarged heads. In this embodiment, the connectors are preferably somewhat loosely held by the insulator, which may be an insulating sheet member such as a sheet of FR-10, so that they "float" (or are able to move slightly), to help provide the desired flexibility.

Yet another alternative is to build in to the ACE material small voids or compressible artifacts, such as small compressible foam pieces, or perhaps air bubbles, that effectively make the elastomer compressible. In this case, the objectives of the invention can be accomplished with only a single layer of this compressible ACE, and without any intervening flex board.

Although specific features of the invention are shown in some drawings and not others, this is for convenience only as some feature may be combined with any or all of the other features in accordance with the invention.

Other embodiments will occur to those skilled in the art and are within the following claims:

The invention claimed is:

1. An Anisotropic Conductive Elastomer (ACE) connector that interconnects two or more electrical circuit elements, comprising:

at least two layers of Anisotropic Conductive Elastomer (ACE), separable from said electrical circuit elements;

one or more alternate interconnection elements comprising conductive elements separating the ACE layers, the interconnection elements defining voids into which the ACE elastomer can move during the interconnection process.

2. The connector of claim 1 wherein an interconnection element comprises a rigid circuit board.

3. The connector of claim 1 wherein an interconnection element comprises a flexible circuit with a pad layer on top that is electrically connected to a pad layer on the bottom of the flexible circuit, wherein said flexible circuit comprises an array of plated through holes that interconnect said pad layer on top and said pad layer on the bottom of the flexible circuit.

4. The connector of claim 2 wherein an interconnection element defines a circuit ground plane, to enhance the transmitted signal.

5. A separable electrical connector for electrically interconnecting two electrical circuit elements, comprising:

an adapter device having a plurality of spaced lands on both sides, thereby defining void volumes at the surfaces between the lands, wherein said adapter device comprises a flex circuit that houses an array of plated through holes that interconnect said lands;

a layer of Anisotropic Conductive Elastomer (ACE) between one of said electrical circuit element and the adapter device; and a second layer of ACE between the other electrical circuit element and the adapter device.

* * * * *